US007775298B2

(12) United States Patent
Zeni

(10) Patent No.: US 7,775,298 B2
(45) Date of Patent: Aug. 17, 2010

(54) DRILLING ASSEMBLIES AND METHODS OF DRILLING

(75) Inventor: John Zeni, Sheridan, WY (US)

(73) Assignee: Abergeldie Holdings Pty Ltd/Abergeldie Plant Pty Ltd, New South Wales (AU)

( * ) Notice: Subject to any disclaimer, the term of this patent is extended or adjusted under 35 U.S.C. 154(b) by 194 days.

(21) Appl. No.: 11/927,294

(22) Filed: Oct. 29, 2007

(65) Prior Publication Data

US 2009/0107726 A1 Apr. 30, 2009

(51) Int. Cl.
*E21B 7/00* (2006.01)

(52) U.S. Cl. ..... 175/57; 175/173

(58) Field of Classification Search ..... 175/162, 175/170, 173, 57; 173/184, 28; 405/259.1, 405/232

See application file for complete search history.

(56) References Cited

U.S. PATENT DOCUMENTS

| | | | | | |
|---|---|---|---|---|---|
| 2,451,223 | A * | 10/1948 | Johansen | 173/28 |
| 2,838,282 | A * | 6/1958 | Colquitt | 173/26 |
| 2,912,225 | A * | 11/1959 | Kandle | 175/57 |
| 3,734,212 | A * | 5/1973 | Perlewitz | 175/171 |
| 3,987,856 | A * | 10/1976 | Carl et al. | 173/149 |
| 4,371,041 | A * | 2/1983 | Becker et al. | 173/28 |
| 5,215,153 | A * | 6/1993 | Younes | 175/162 |
| 5,394,949 | A * | 3/1995 | Wright et al. | 175/20 |
| 6,435,280 | B1 | 8/2002 | Van Wechem et al. | |
| 6,725,949 | B2 | 4/2004 | Seneviratne | |
| 6,736,224 | B2 * | 5/2004 | Kinsella | 175/58 |
| 7,004,259 | B2 | 2/2006 | Pietras | |
| 7,191,840 | B2 | 3/2007 | Pietras et al. | |
| 2007/0144784 | A1 * | 6/2007 | Head et al. | 175/57 |

FOREIGN PATENT DOCUMENTS

| | | |
|---|---|---|
| WOWO | PCT/US2008/078291 | 5/2010 |

* cited by examiner

*Primary Examiner*—David J Bagnell
*Assistant Examiner*—Kipp C Wallace
(74) *Attorney, Agent, or Firm*—Wells St. John P.S.

(57) ABSTRACT

Drilling assemblies and methods of drilling are disclosed. In one implementation, a drilling assembly includes a rotary drive apparatus configured to rotate a string of drill pipe having a cutting head at a drilling end thereof. A longitudinally elongated torque transfer tube apparatus is mounted to and extends downwardly from the rotary drive apparatus and is configured to longitudinally receive the string of drill pipe rotatably there-through. The torque transfer tube apparatus is isolated from rotation relative to the rotary drive apparatus and the string of drill pipe during drilling with the drilling assembly. A torque receiving structure is provided, and through which the torque transfer tube apparatus is upwardly and downwardly slidably received. The torque transfer tube apparatus and the torque receiving structure are isolated from rotation relative one another and the string of drill pipe during drilling with the drilling assembly.

39 Claims, 17 Drawing Sheets

DRILLING ASSEMBLIES AND METHODS OF DRILLING

TECHNICAL FIELD

This invention relates to drilling assemblies and to methods of drilling.

BACKGROUND OF THE INVENTION

When drilling holes into the earth, a string of drill pipe is rotated and driven into the earth to form the hole. The end of the string of drill pipe includes a cutting head which dislodges the earthen material as the drill pipe string is driven deeper into the earth. Water is typically flowed into the hole being drilled, with the water and removed earthen material flowing upwardly around or within the rotating drill pipe and outwardly of the hole being drilled.

The apparatus which rotates the drill string is of course subjected to a counter rotational force in a direction opposite to the direction the drill string is rotated. The larger the diameter of the cutting head at the end of the drill string, the larger the counter rotational force or torque for a given speed of rotation of the drill pipe string. In some instances, the cutting head diameter can reach up to 20 feet, and beyond. Needs remain for improved manners of contending with the counter rotational force where cutting head diameters exceed about 10 feet in diameter.

While the invention was motivated in addressing the above identified issues, it is in no way so limited. The invention is only limited by the accompanying claims as literally worded, without interpretative or other limiting reference to the specification, and in accordance with the doctrine of equivalents.

SUMMARY

The invention includes drilling assemblies and methods of drilling. In one implementation, a drilling assembly includes a rotary drive apparatus configured to rotate a string of drill pipe having a cutting head at a drilling end thereof. A longitudinally elongated torque transfer tube apparatus is mounted to and extends downwardly from the rotary drive apparatus and is configured to longitudinally receive the string of drill pipe rotatably there-through. The torque transfer tube apparatus is isolated from rotation relative to the rotary drive apparatus and the string of drill pipe during drilling with the drilling assembly. A torque receiving structure is provided, and through which the torque transfer tube apparatus is upwardly and downwardly slidably received. The torque transfer tube apparatus and the torque receiving structure are isolated from rotation relative one another and the string of drill pipe during drilling with the drilling assembly.

In one implementation, a method of drilling includes supporting a longitudinally elongated torque transfer tube apparatus extending beneath a rotary drive apparatus at least partially above a hole in the earth. The rotary drive apparatus is connected with a first segment of drill pipe that extends into the torque transfer tube apparatus and connects with a string of drill pipe received within the hole. The first segment along with the string of drill pipe are rotated within and relative to the torque transfer tube apparatus with the rotary drive apparatus to drill into the earth while sliding the torque transfer tube apparatus a) through and in contact with a torque receiving structure received at least partially within the earth, and b) into the hole. Such rotating and sliding are repeated with a second segment of drill pipe.

Other aspects and implementations are contemplated.

BRIEF DESCRIPTION OF THE DRAWINGS

Preferred embodiments of the invention are described below with reference to the following accompanying drawings.

FIG. 5 is a diagrammatic enlarged perspective view of a portion of the FIG. 1 assembly in the FIG. 4 operational orientation.

FIG. 14 is a diagrammatic downward view of a portion of the FIG. 1 assembly.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
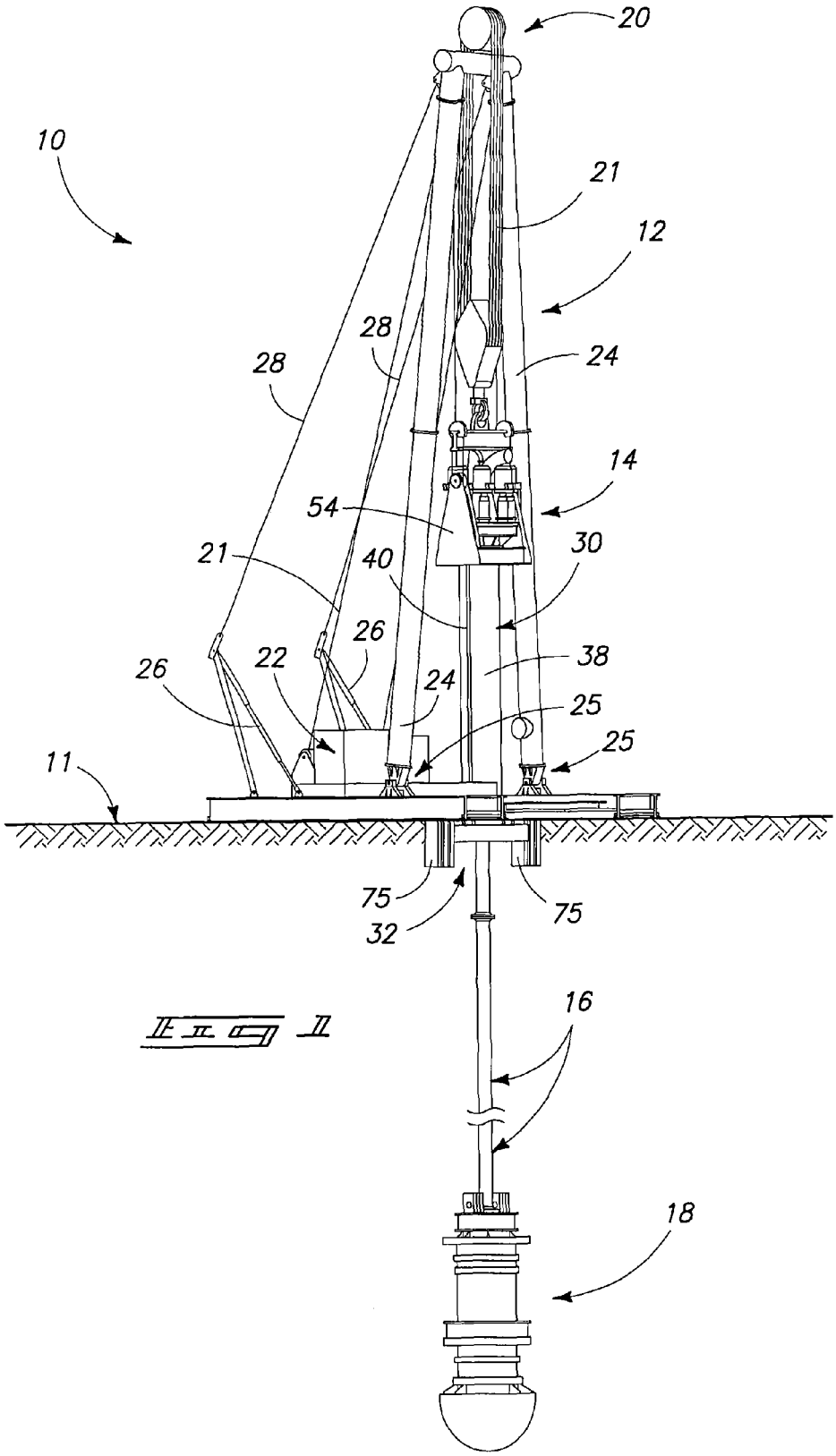
FIG. 1 is a diagrammatic representation of a drilling assembly in accordance with an embodiment of the invention, and in one operational orientation.

Referring initially to FIG. 1, a preferred embodiment drilling assembly is indicated generally with reference numeral 10, with such being shown as received over an example ground surface 11 into or through which a bore hole is to be drilled. In one embodiment, drilling assembly 10 comprises a drill rig mast apparatus 12 extending upwardly relative to ground surface 11. Drilling assembly 10 includes a rotary drive apparatus 14 configured to rotate a string of drill pipe having a cutting head at a drilling end thereof. For example, FIG. 1 depicts a drill pipe string 16 having a cutting head apparatus 18 at the drilling or working end thereof. Rotary drive apparatus 14 is supported for up and down movement by drill rig mast apparatus 12. In the depicted embodiment, such is accommodated for by drill rig mast apparatus 12 comprising a suitable block and tackle mechanism 20 having associated cables 21 driven by a winch mechanism 22. Rotary drive apparatus 14 is supported for raising and lowering relative to ground surface 11 between a pair of boom legs 24 which comprise a part of drill rig mast apparatus 12. Boom legs 24 are supported by pivots 25 for pivoting action at the bases of legs 24 for moving rotary drive apparatus 14 laterally relative to ground surface 11, and as will be described in greater detail below. Drill rig mast apparatus 12 comprises a pair of hydraulic cylinders 26 which connect with cables 28 that extend and connect with the upper ends of boom legs 24. Hydraulic cylinders 26 can be extended and retracted for pivoting boom legs 24 about pivots 25. Alternate configurations, whether existing or yet-to-be developed, are also of course contemplated.

Drilling assembly 10 comprises a longitudinally elongated torque transfer tube apparatus 30 which is mounted to and extends downwardly from rotary drive apparatus 14. Such is configured to longitudinally receive drill pipe string 16 rotatably there-through for rotating and driving example cutting head apparatus 18 at the drilling end thereof. Torque transfer tube apparatus 30 is isolated from rotation relative to rotary drive apparatus 14 and from rotation relative to drill pipe string 16 during drilling with the drilling assembly. Example embodiment manners of such rotation isolation are described below.

Drilling assembly 10 also includes a torque receiving structure 32 through which torque transfer tube apparatus 30 is upwardly and downwardly slidably received. Torque transfer tube apparatus 30 and torque receiving structure 32 are isolated from rotation relative to one another and drill pipe string 16 during drilling with the drilling assembly, as will become apparent form the continuing discussion.

Referring to FIGS. 1 and 15-18, torque transfer tube apparatus 30 can be considered as having an upper end 34 and a lower end 36. In one embodiment and as shown, torque transfer tube apparatus 30 has a non-circular external shape in transverse cross-section which engages with rotary drive apparatus 14 and torque receiving structure 32 to isolate the torque transfer tube apparatus from rotating relative to the rotary drive apparatus and the drill pipe string during drilling with the drilling assembly. Torque transfer tube apparatus 30 is depicted as being comprised of a longitudinally elongated tube portion 38 which encircles drill string 16 in operation. Encircling portion 38 may or may not be circular, with the example tube portion 38 being shown to be generally internally and externally circular in transverse cross-section but for a pair of diametrically opposed rectangular projections 40 received externally of main tube portion 38, and which are oriented or project transversely relative thereto. Transverse projections 40 extend at least along a majority of the length of transfer tube apparatus 30, and are shown extending along the entirety thereof. In one embodiment, the torque transfer tube apparatus comprises a plurality of longitudinal projections extending upwardly therefrom. In one embodiment, the plurality of longitudinal projections comprises a pair of diametrically opposed longitudinal projections. In the depicted embodiment, a pair of such longitudinal projections is designated with reference numeral 43. Further in the depicted embodiment, and by way of example only, longitudinal projections 43 comprise longitudinal extensions of transverse projections 40, and which are received by the rotary drive apparatus as is described below.

Such transverse projections provide but one manner by which a torque transfer tube apparatus can be provided to have a non-circular external shape which is received by or engages a rotary drive apparatus in a manner (described subsequently) which isolates the drive apparatus and torque transfer tube apparatus from rotating relative to one another. Such also provides but one manner by which counter rotational force or torque is transmitted from the rotary drive apparatus to the torque transfer tube apparatus. Alternate manners, whether existing or yet-to-be developed are also of course contemplated.

Torque transfer tube apparatus 30 comprises radial projections 41 proximate upper end 34, and which have holes 42 received laterally there-through. Radial projections 41 are depicted as being diametrically opposed. In one embodiment, such provide a manner of attaching or supporting torque transfer tube apparatus 30 elevationally relative to rotary drive apparatus 14, as will be described subsequently. In one embodiment, radial projections 41 also preclude torque transfer tube apparatus 30 from being able to slide completely downwardly through an opening in torque receiving structure 32, also as will be described subsequently. Torque transfer tube apparatus 30 also comprises a pair of diametrically opposed radial projections 44 having holes 46 received there-through. In one embodiment, such may be used for raising and lowering torque transfer tube apparatus 30 relative to rotary drive apparatus 14 in certain operational configurations, as will also be described below.

Torque transfer tube apparatus 30 is depicted as comprising inwardly projecting and opposing funnel-like guides 47, and an upper plate 48. Guides 47 may facilitate central orienting of torque transfer tube apparatus 30 relative to a pair of interconnected flanges on the drill pipe string when raising and lowering torque transfer tube apparatus relative to rotary drive apparatus 14.

Figure 11:
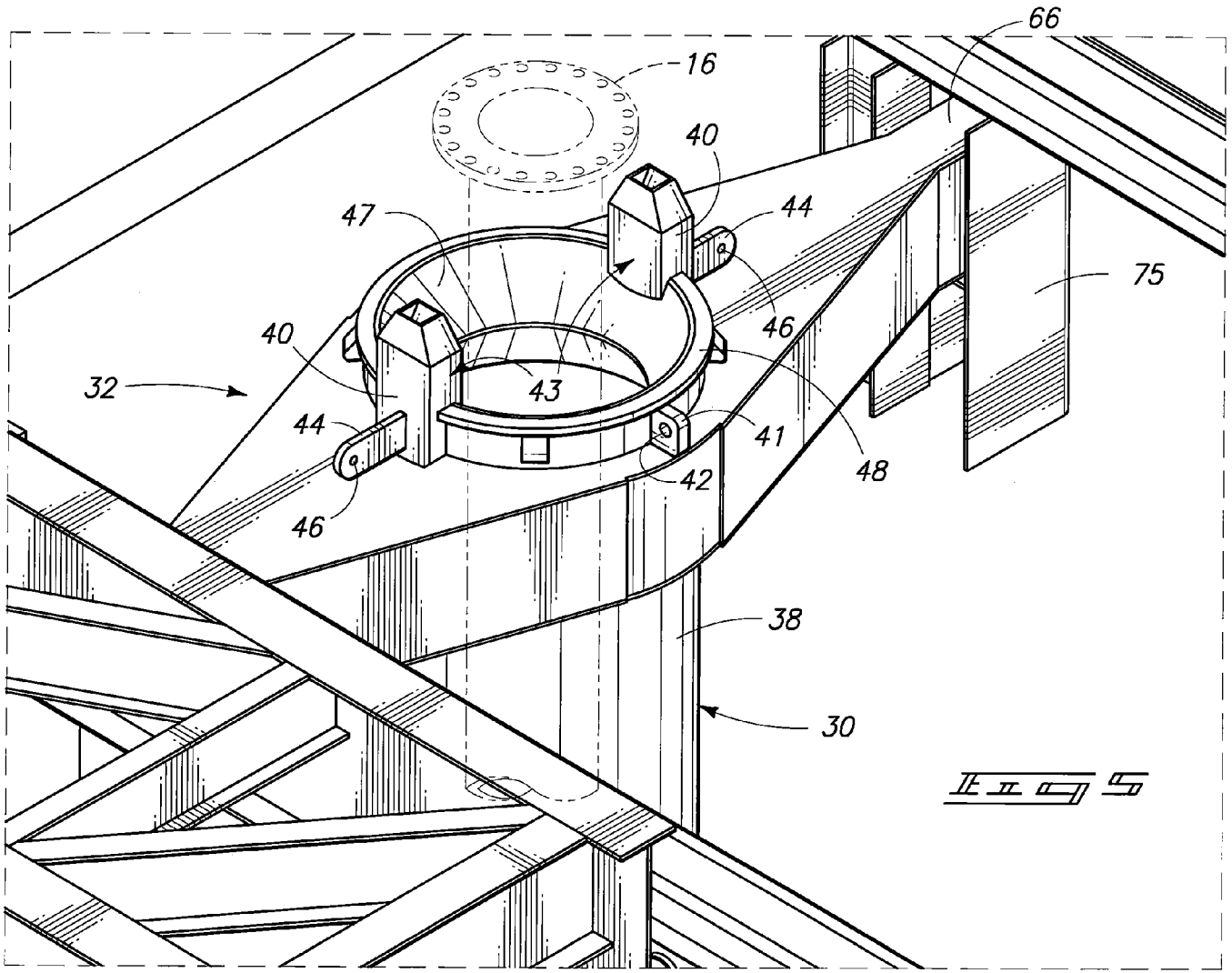
FIG. 11 is a diagrammatic representation of FIG. 10 rotated ninety degrees.
Figure 6:
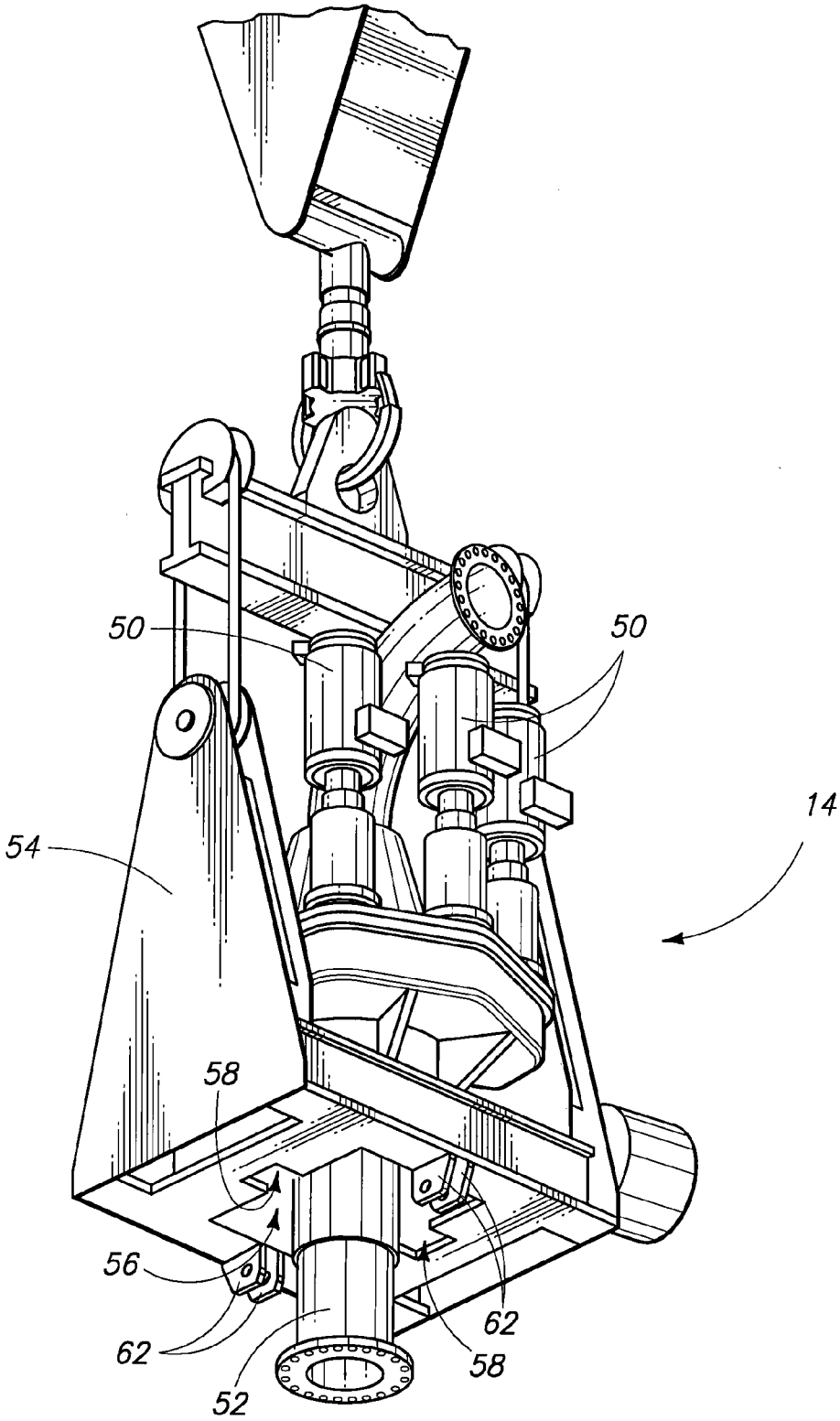
FIG. 6 is a diagrammatic enlarged perspective view of a portion of the FIG. 1 assembly in the FIG. 4 operational orientation.
Figure 10:
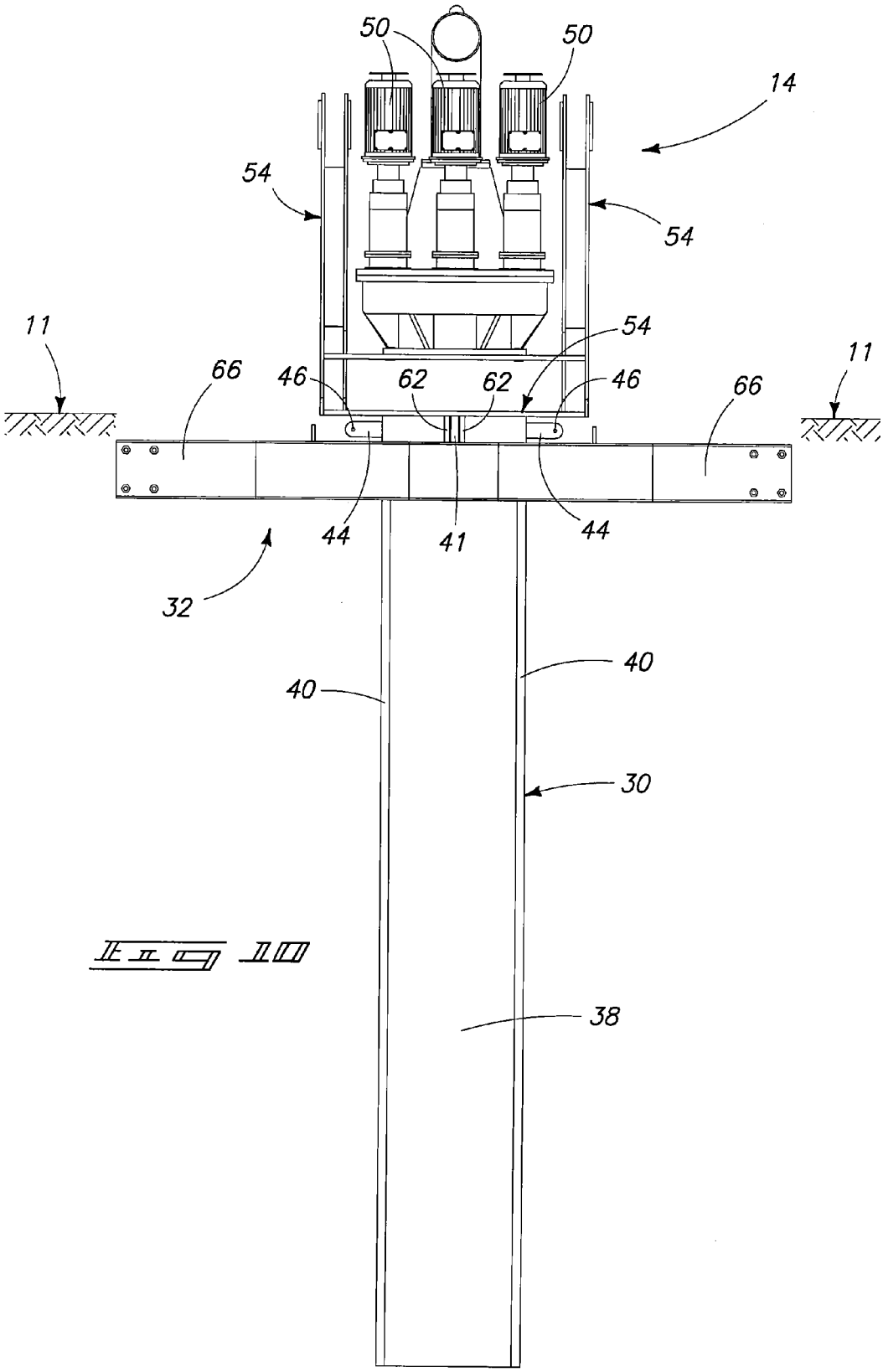
FIG. 10 is a diagrammatic enlarged view of a portion of the FIG. 1 assembly in the FIG. 3 operational configuration.
Figure 11:
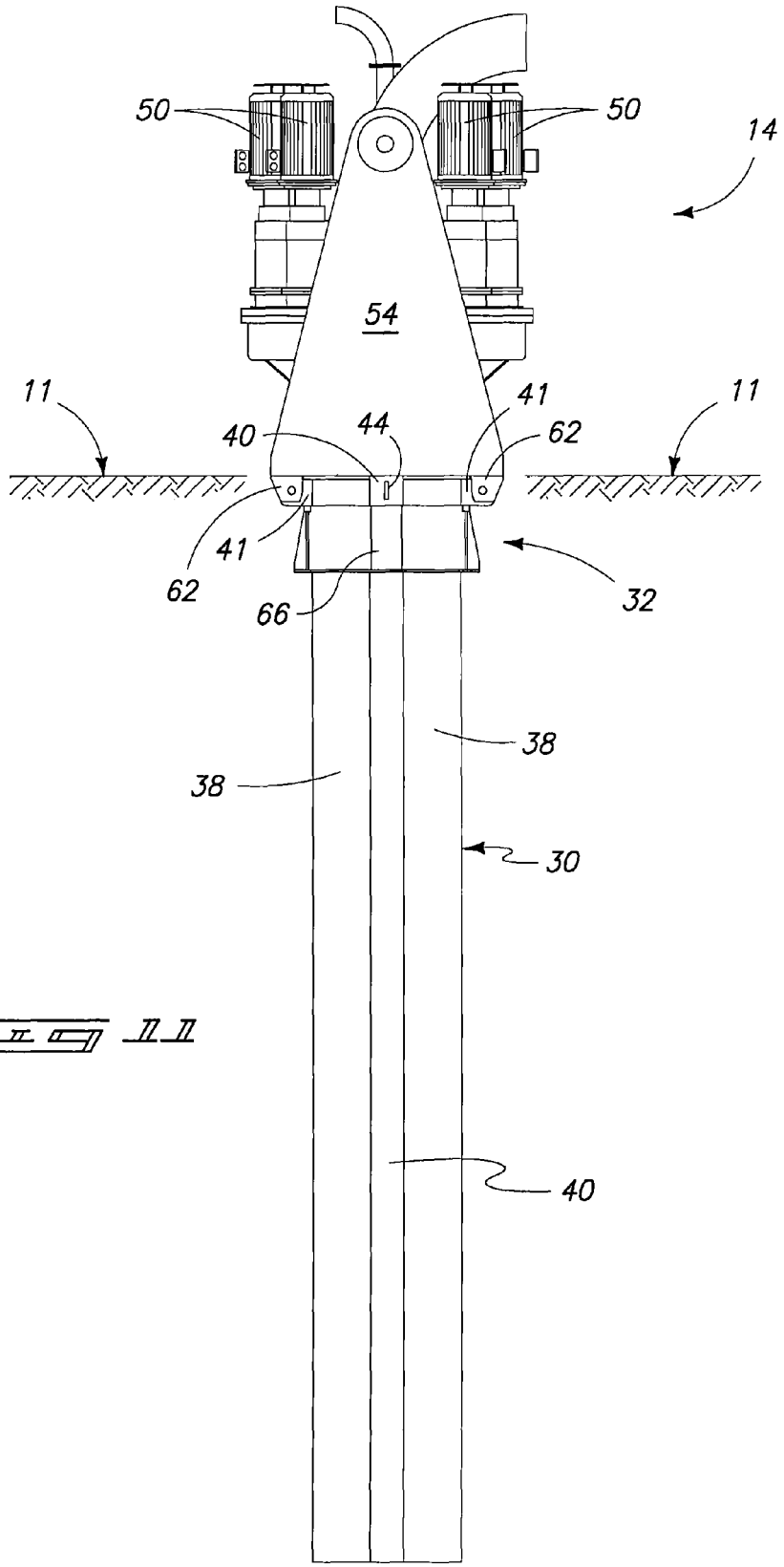
Figure 12:
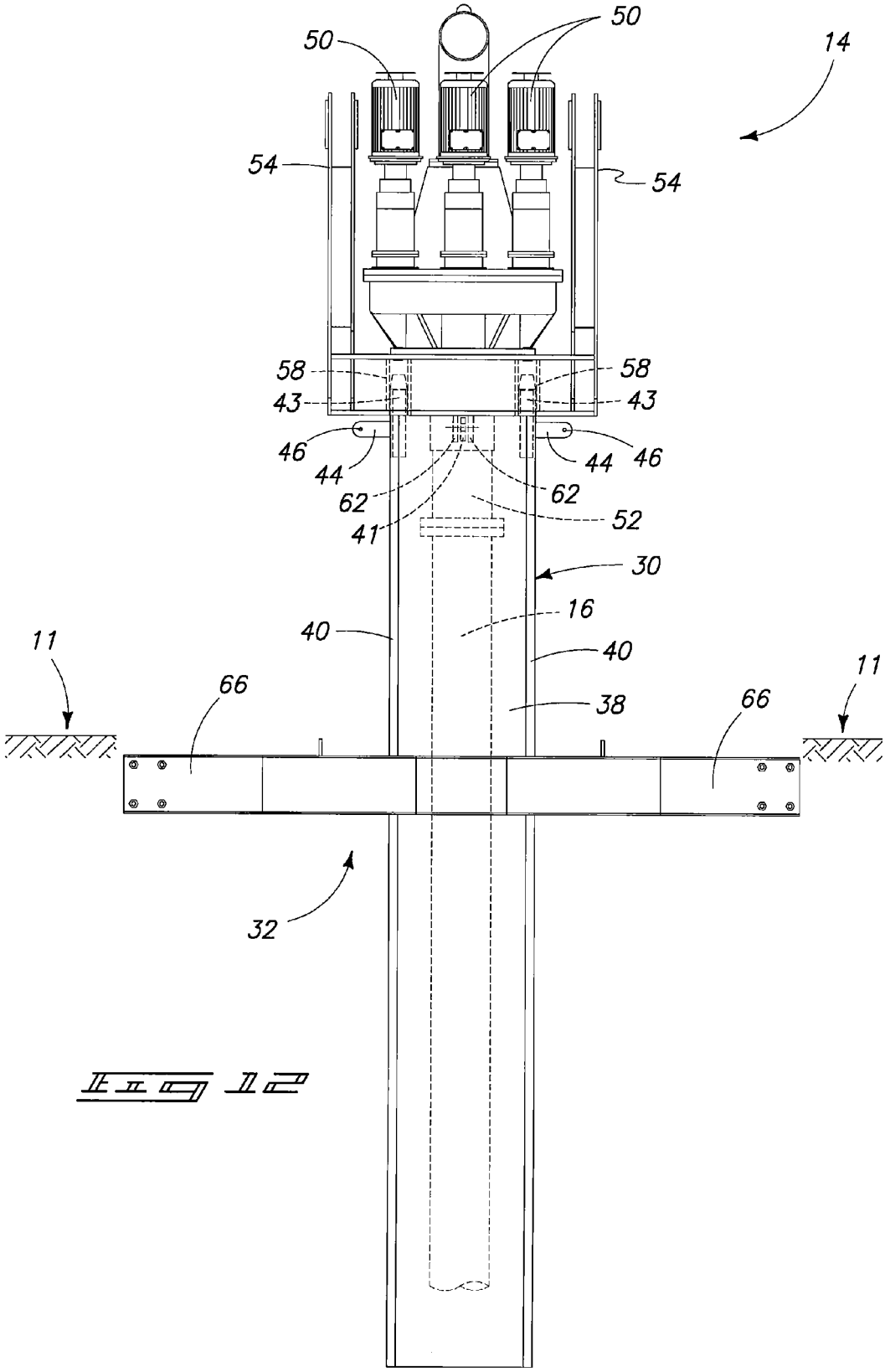
FIG. 12 is a diagrammatic enlarged view of a portion of the FIG. 1 assembly in the FIG. 2 operational configuration.
Figure 13:
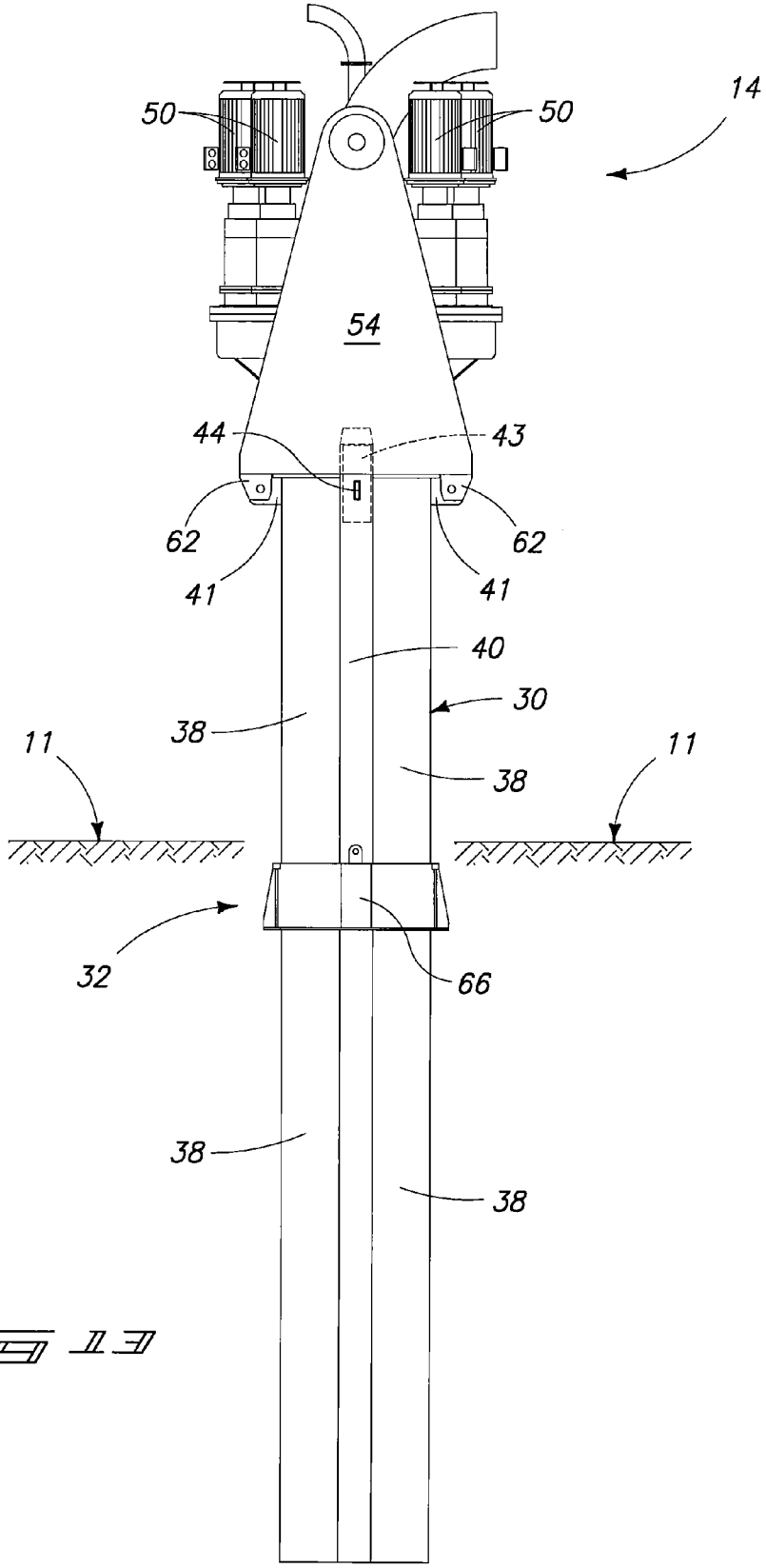
FIG. 13 is a diagrammatic representation of FIG. 12 rotated ninety degrees.
Figure 11:
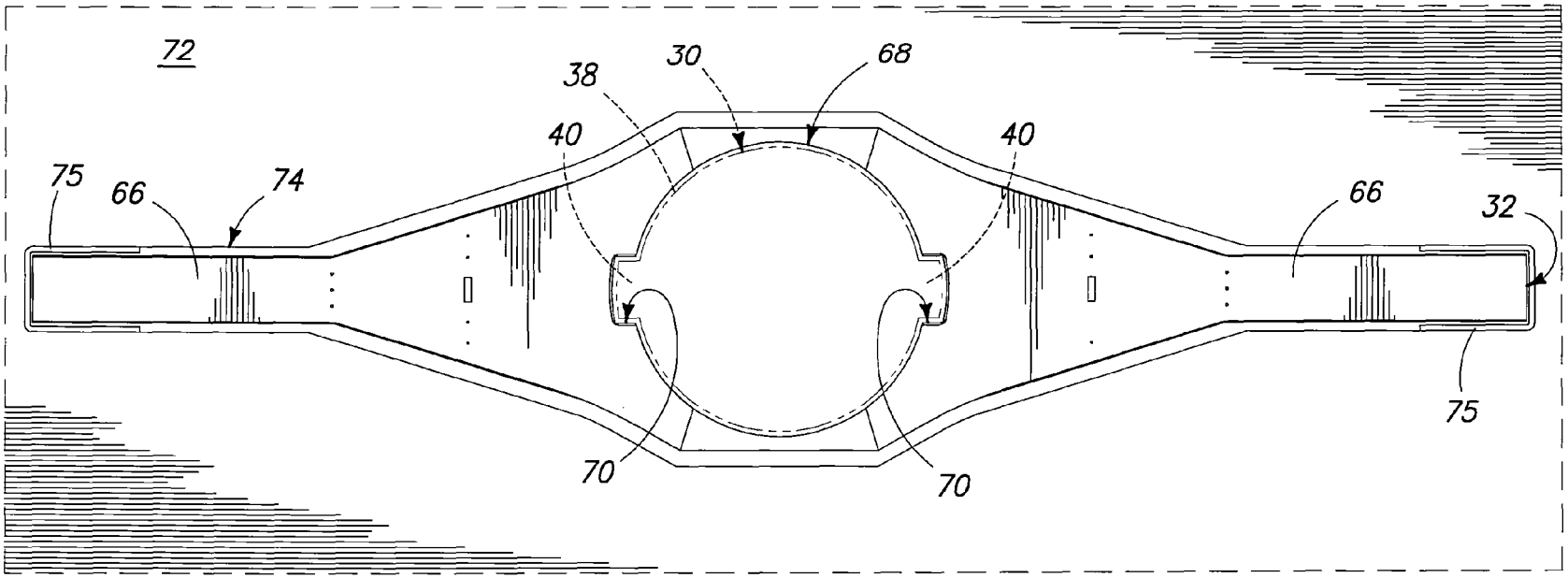
Figure 15:
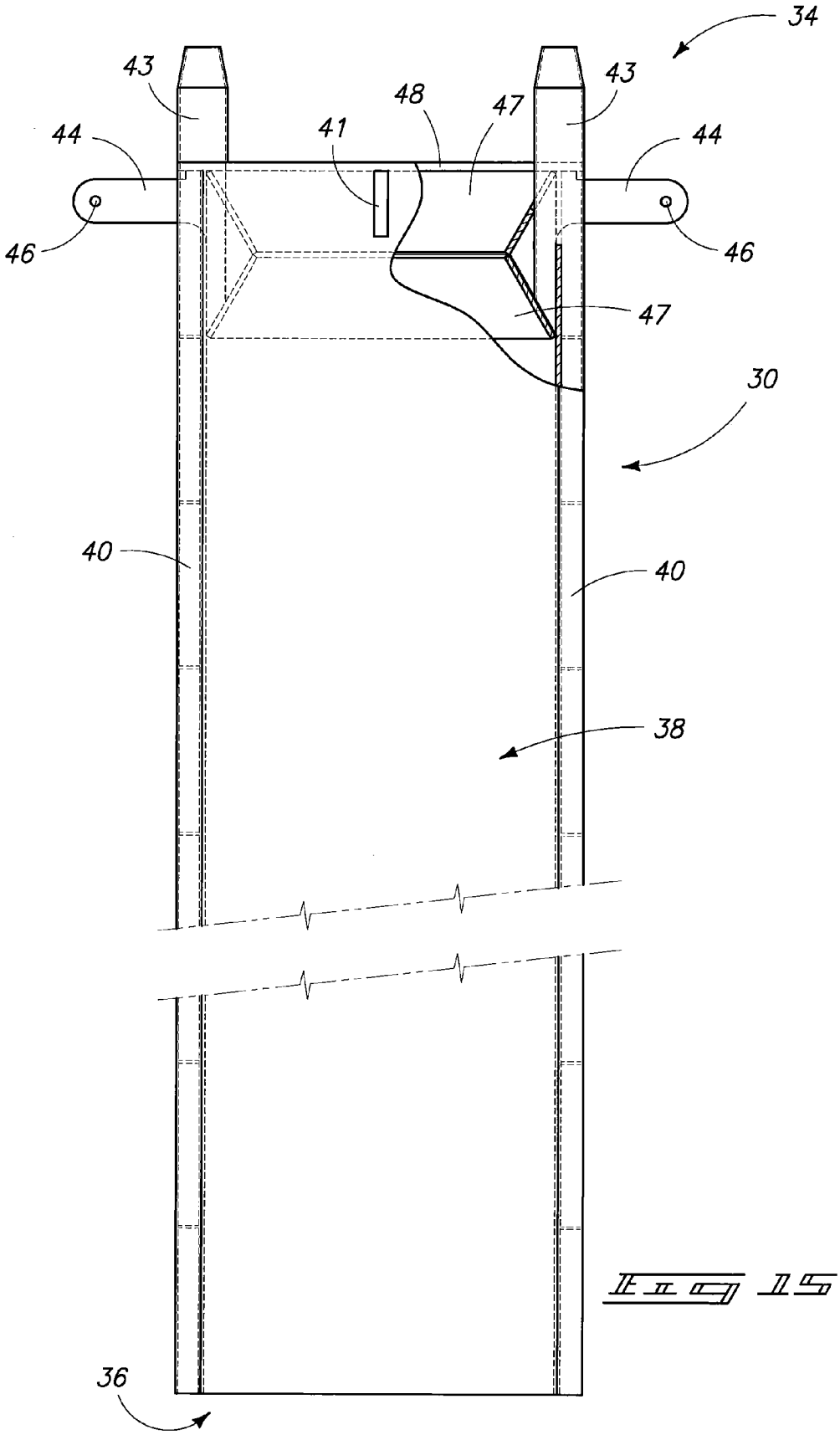
FIG. 15 is a diagrammatic side elevational view of a torque transfer tube apparatus which is part of the FIG. 1 assembly.
Figure 16:
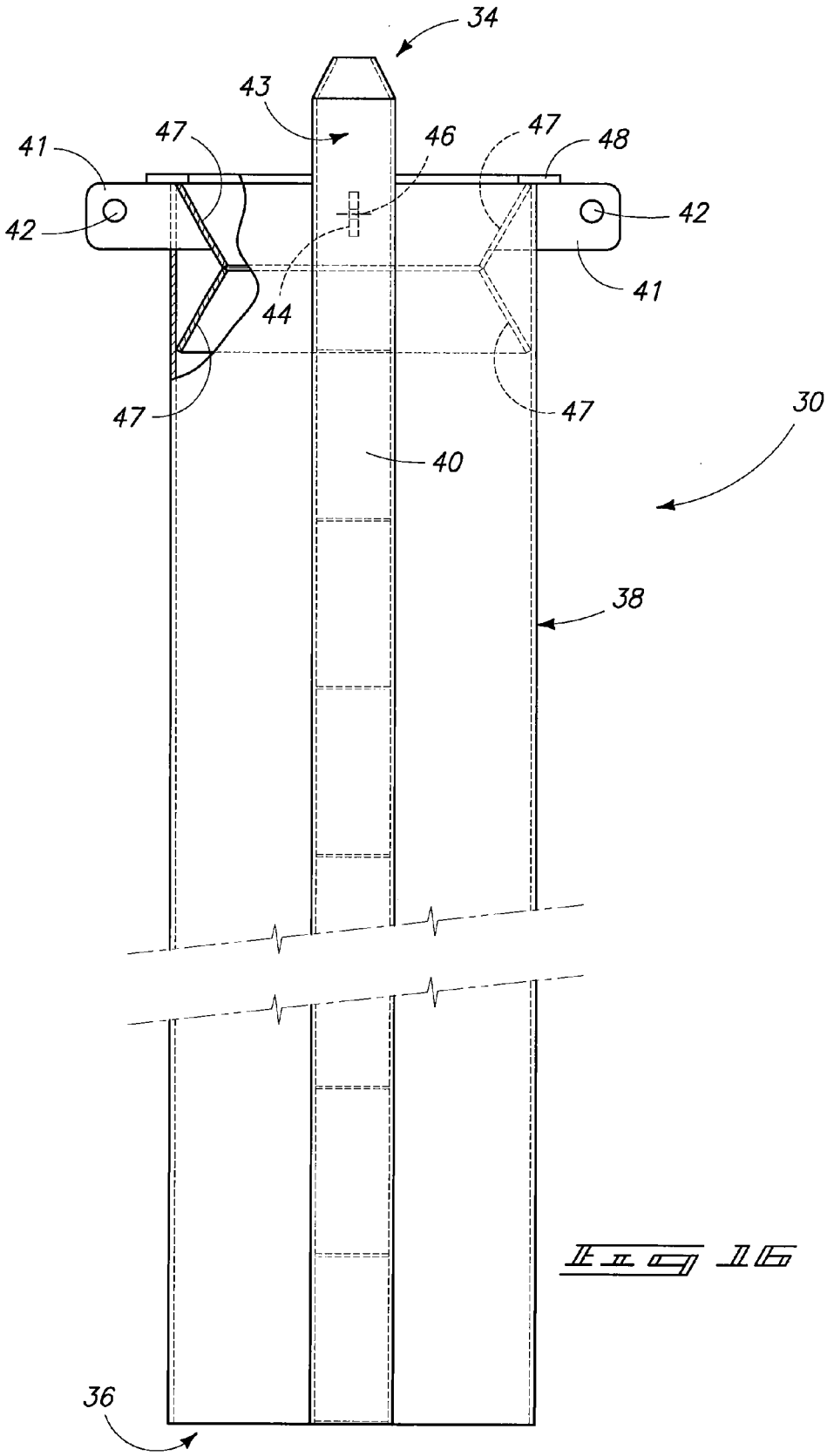
FIG. 16 is a diagrammatic representation of FIG. 15 rotated ninety degrees.
Figure 17:
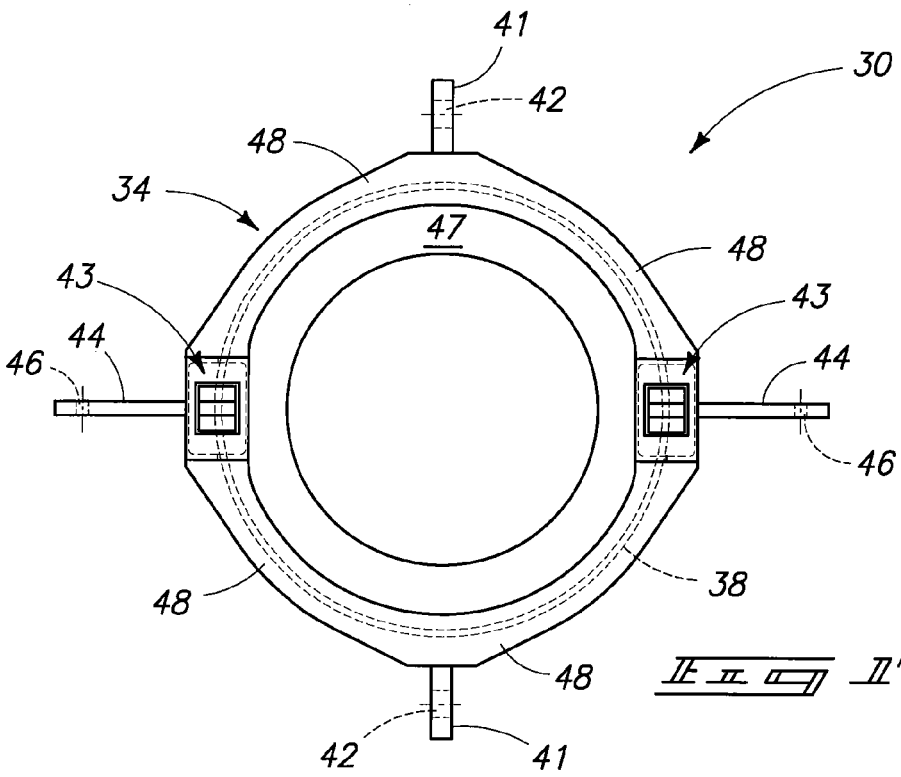
FIG. 17 is a top-down view of the FIG. 15 apparatus.
Figure 18:
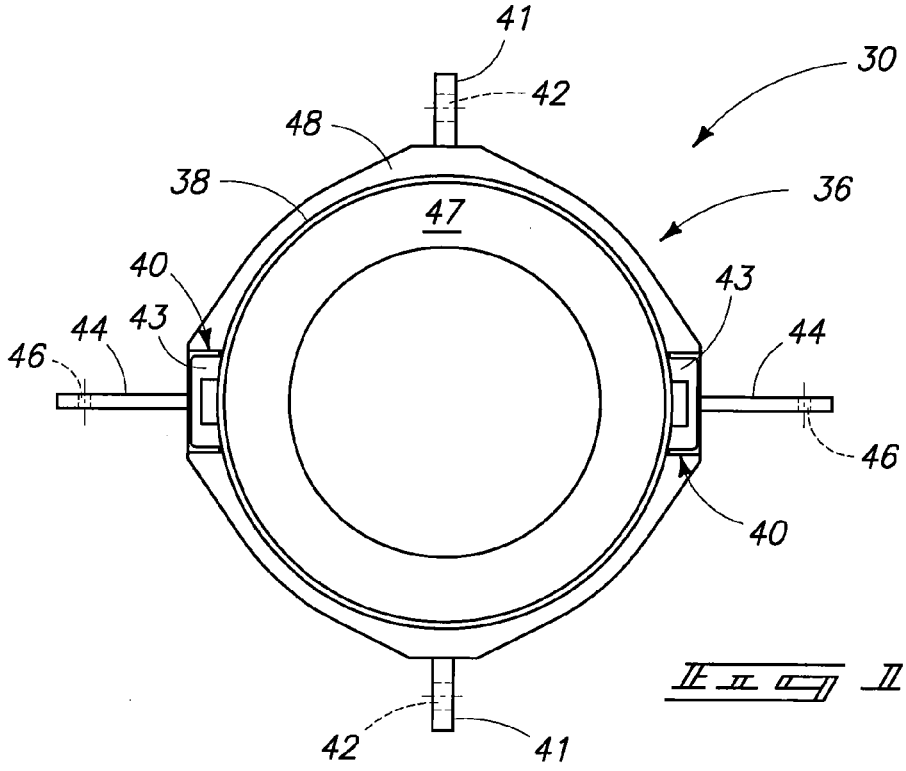
FIG. 18 is a bottom-up view of the FIG. 15 apparatus.

Referring to FIGS. 5, 6, and 10-13, a preferred embodiment rotary drive apparatus 14 and interconnection relative to torque transfer tube apparatus 30 is next described. FIGS. 12 and 13 are diagrammatic depictions of rotary drive apparatus 14 having torque transfer tube apparatus 30 secured thereto in a mid-stroke relative to drilling or extraction relative to a bore hole extending through ground surface 11. FIGS. 10 and 11 are depictions of the interconnected drive apparatus 14 and torque transfer tube apparatus 30 at completion of a drilling stroke into ground surface 11. FIGS. 5 and 6 depict drive apparatus 14 and torque transfer tube apparatus 30 being disconnected from one another for ease of describing the configuration and interconnection of the torque transfer tube apparatus and rotary drive apparatus.

By way of example only, rotary drive apparatus 14 is shown as including six electric drive motor assemblies 50 having downwardly oriented drive shafts (not shown) which drive a ring gear (not shown) for centrally driving a flanged output shaft 52 which connects to a flanged portion of a segment of drill pipe string 16 (FIG. 12). Rotary drive apparatus 14 includes a drive lifting frame 54 which supports drive motor assemblies 50 and a housing within which the ring gear is rotatably received. Drive lifting frame 54, and thereby rotary drive apparatus 14, includes an opening 56 (FIG. 6) therein into which upper end 34 of torque transfer tube apparatus 30 is received. In the depicted example, transverse projections 40 are slidable upwardly and downwardly within corresponding transverse slots or openings 58 associated with opening 56 in drive lifting frame 54, thereby securing torque transfer tube apparatus 30 from rotating relative to rotary drive apparatus 14 and a string of drill pipe received within torque transfer tube apparatus 30. Accordingly, counter rotating torque action against rotary drive apparatus 14 the result of rotating a string of drill pipe is transmitted from rotary drive apparatus 14 to torque transfer tube apparatus longitudinal projections 43, to transverse projections 40, and thereby to torque transfer tube apparatus 30. Transverse slots 58 may be reinforced by or provided with upwardly extending channel members (not shown) for engagement with longitudinal projections 43 extending upwardly therein.

A pair of clevis-like plates 62 extends downwardly from drive lifting frame 54 and straddle radial projections 41 on torque transfer tube apparatus 30. A hole is provided therethrough which aligns with hole 42 in radial projections 41. A pin (not shown) may be provided through the illustrated holes for securing torque transfer tube apparatus 30 and rotary drive apparatus 14 elevationally relative to one another. In one example embodiment, the stated pin (not shown) could be driven and supported by a hydraulic cylinder (not shown) mounted to the underside of frame 54 for insertion of the pin into and out of the aligned holes of clevis projections 62 and hole 42 on radial projections 41. (Clevis-like plates 62 are not shown in FIGS. 1-4 and 7-9 for clarity in such larger perspective, but smaller scale, depictions.)

Referring to FIGS. 5 and 10-14, engagement of torque transfer tube apparatus 30 relative to torque receiving structure 32 is described. Torque transfer tube apparatus 30 is upwardly and downwardly slidably received through torque receiving structure 32. In example preferred embodiments, torque receiving structure 32 in operation is received at least partially below ground surface 11, with such being shown as being received entirely below ground surface 11 in the depicted preferred embodiment. However, the torque receiving structure could be anchored to the earth entirely above ground surface 11 (not shown), also including for example being received entirely above ground surface 11 by another structure (not shown) that is itself physically anchored to the earth or by virtue of its own weight.

Further and regardless, in the depicted embodiment, torque receiving structure 32 is elongated transverse the longitudinally elongated torque transfer tube apparatus 30, and in one embodiment is depicted as comprising a pair of opposing transverse projecting legs 66. Torque receiving structure 32 includes an opening 68 (FIG. 14) through which torque transfer tube apparatus 30 is slidably received. Torque receiving structure opening 68 is non-circular in transverse cross-section to largely correspond to the non-circular external shape of torque transfer tube apparatus 30. For example in the depicted embodiment, torque receiving structure opening 68 is shown as having a pair of diametrically opposed transverse slots 70 within which transverse projections 40 of transfer tube apparatus 30 are slidably received.

In one embodiment, a suitable support structure is received at least partially below ground surface 11 for receiving and supporting torque receiving structure 32 from rotation relative to ground surface 11. In one embodiment, at least a majority and perhaps all of the support structure is received below ground surface 11. FIG. 14 depicts an example support structure in the form of a concrete mass 72 having an opening 74 therein which conforms to the outline of torque receiving structure 32. Thereby, torque receiving structure 32 can be slid into and out of concrete mass 72. An example pair of metal inserts 75 can be provided within the ground to extend at least partially below ground surface 11, and for example to be received by concrete mass 72, to facilitate sliding insertion and removal of torque receiving structure 32 relative to ground surface 11. Again however, a suitable support structure (for example concrete or other material and/or construction) for the torque receiving structure could be physically anchored to the earth or by virtue of its own weight entirely above ground surface 11.

With the above exemplary implementation, rotation of drill pipe string 16 by rotary drive apparatus 14 when drilling into the earth with cutting head 18 results in a counter rotational force applied against rotary drive apparatus 14. Such is transmitted from rotary drive apparatus 14 to torque transfer tube apparatus 30 via longitudinal projections 43. In turn, torque transfer tube apparatus 30 transfers such torque to torque receiving structure 32 through transverse projections 40. Thereby, rotary drive apparatus 14 and torque transfer tube apparatus 30 may be isolated from counter rotation from driving action of drill pipe string 16 to drill into the earth with cutting head 18.

The above described example embodiment provides engagement of the torque receiving structure and torque transfer tube apparatus by external configurations which are non-circular yet slidable relative to one another. Such is shown, and by way of example only, as being accommodated for by at least two pairs of a mating transverse slot and transverse projection on the torque transfer tube apparatus and the torque receiving structure to both enable longitudinal sliding relative one another and to preclude rotation of the torque transfer tube apparatus relative to the torque receiving structure during drilling with the drilling assembly. The two of the at least two pairs of a transverse slot and a transverse projection are diametrically opposed to one another relative the torque transfer tube apparatus. Only two such pairs are shown, although perhaps only one pair or more than two pairs might also be used. Further, such depict the transverse projections as being on the torque transfer tube apparatus and the mating transverse slot being on the torque receiving structure. This might, of course, be reversed in one or all instances.

Further, alternate non-circular external configurations for the torque transfer tube apparatus and an opening within the torque receiving structure might additionally or alternately be utilized. For example, polygon cross-sections for the torque transfer tube apparatus and torque receiving structure opening might be utilized. For example and by way of example only, the torque transfer tube apparatus 30 might be triangular, square, rectangular, pentagonal, hexagonal, etc., in external shape to preclude rotation of either of the torque receiving structure and the torque transfer tube apparatus and relative to one another. Further of course, any of the above just-described configurations might be utilized in interconnecting an upper end of the torque transfer tube apparatus with the rotary drive apparatus for precluding rotation of the torque transfer tube apparatus and rotary drive apparatus relative to one another and the rotation of a drill pipe string received by the rotary drive apparatus and within the torque transfer tube apparatus.

For example and by way of example only, a torque transfer tube might be configured with a hexagonal external cross section. The opening in a torque receiving structure could therewith be made correspondingly hexagonal such that the torque transfer tube apparatus can slide into and out of the torque receiving structure but not rotate relative thereto due to the hexagonal engagement. Further by way of example only in such instance, an opening in the lower portion of the rotary drive apparatus could comprise a corresponding hexagonal shape which slidably receives the external hexagonal shape of the torque transfer tube, and thereby preclude rotation of the torque transfer tube apparatus and rotary drive apparatus relative to one another. Alternate shapes which preclude rotation are also of course contemplated.

Greater rotational torque is required or results the greater the diameter of the cutting head. The invention is believed to have its greatest applicability for wider diameter cutting heads having an outer diameter of at least 10 feet. Further, in the depicted and preferred embodiment, the longitudinally elongated torque tube apparatus is sized to have a sufficiently great internal diameter to preclude contact of the string of drill pipe for which the assembly is designed with the torque transfer tube apparatus during drilling with the drilling assembly. Ideally, the torque tube apparatus is constructed to be the stronger element as compared to the drill string so in the event of failure in operation due to torque, it would be the drill string that fails as opposed to any portion of the torque tube apparatus.

Aspects of the invention also encompass methods of drilling. In example embodiments, a longitudinally elongated torque transfer tube apparatus is supported to be extending beneath a rotary drive apparatus at least partially above a hole in the earth, with the rotary drive apparatus being connected with a first segment of drill pipe that extends into the torque transfer tube apparatus and connects with a string of drill pipe received within the hole. By way of example only, FIG. 1 depicts such an example configuration.

Figure 2:
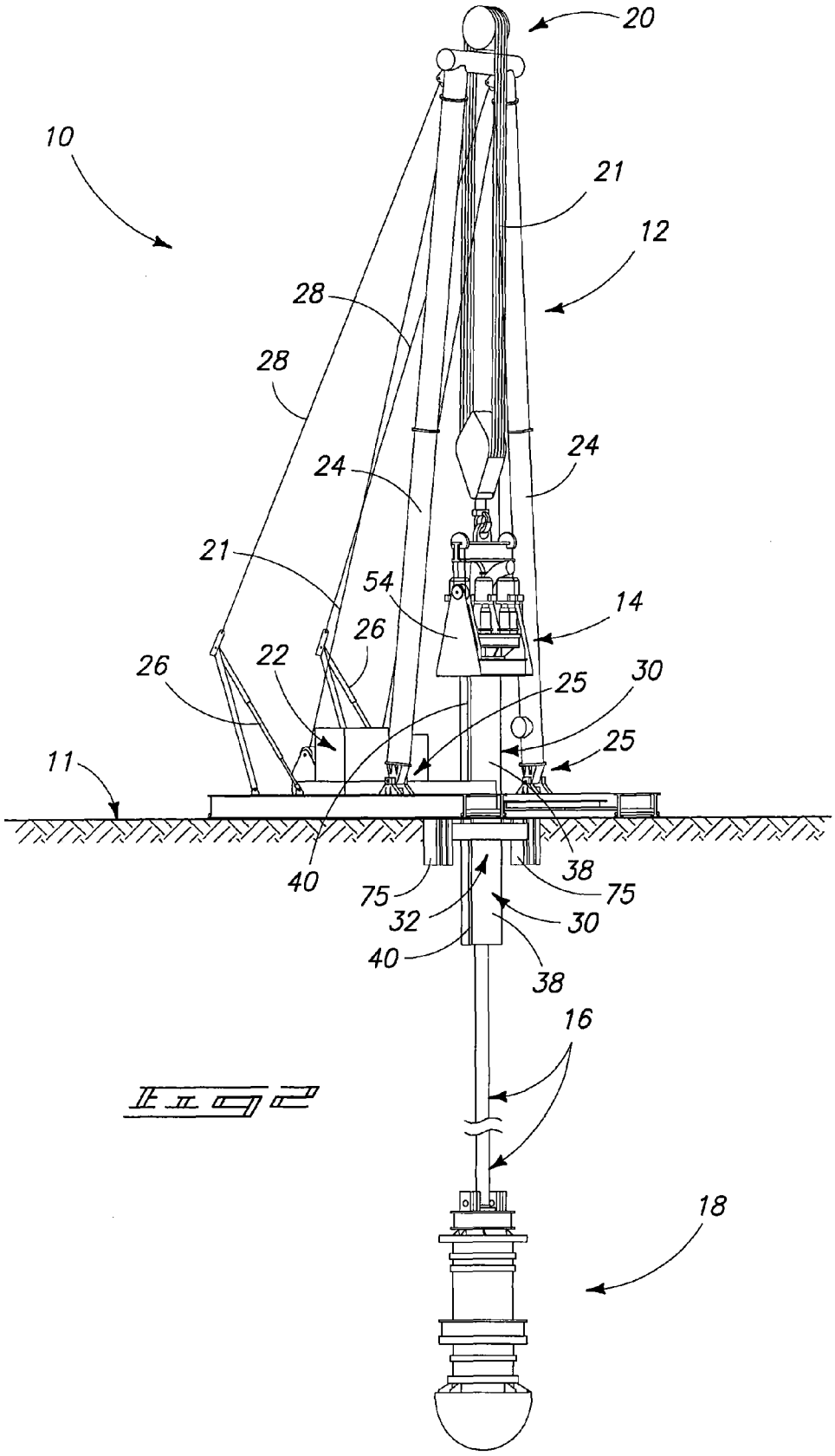
FIG. 2 is a view of the FIG. 1 assembly in another operational orientation.
Figure 3:
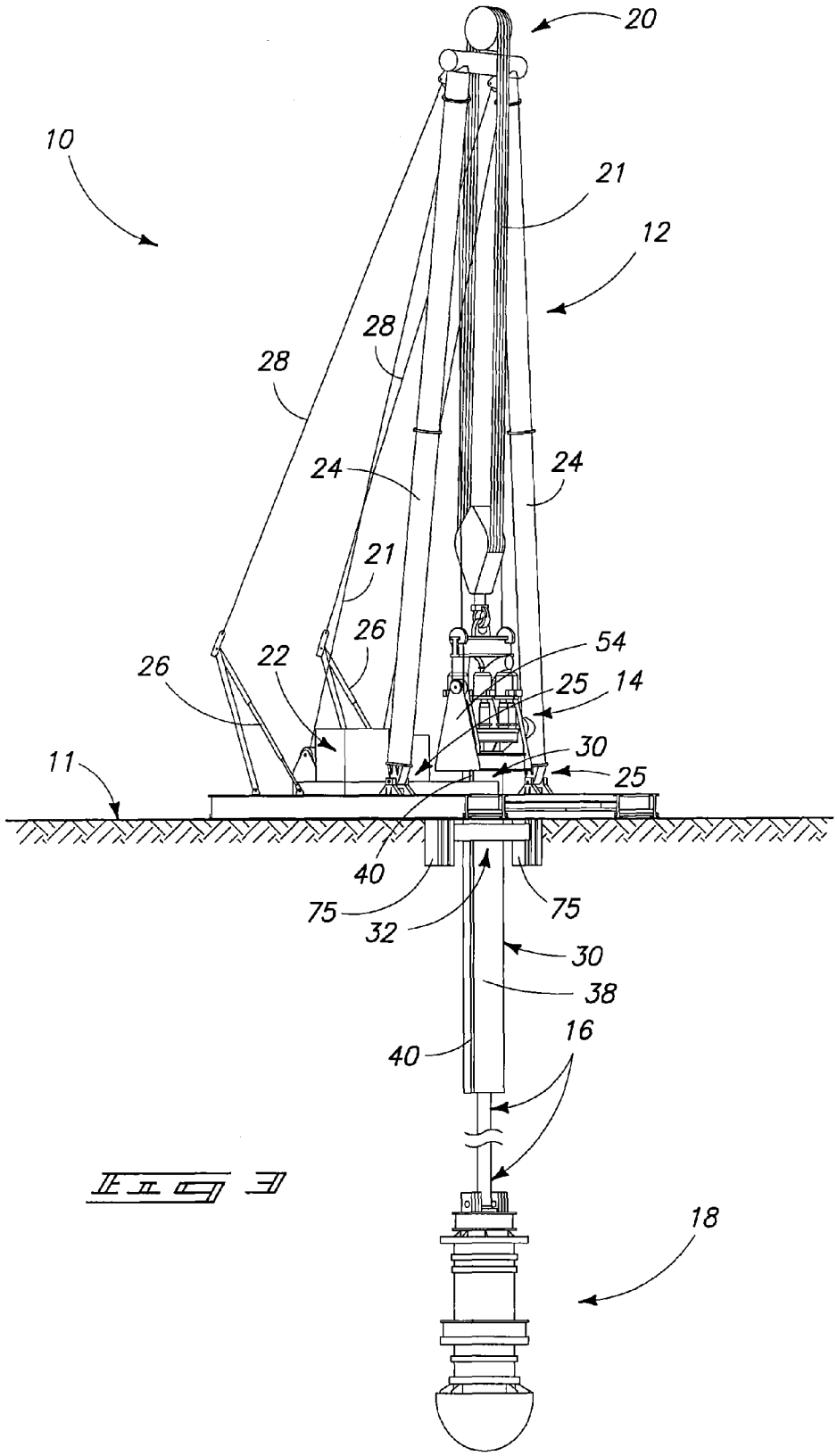
FIG. 3 is a view of the FIG. 1 assembly in still another operational orientation.

The segment of drill pipe connected to the rotary drive apparatus, and thereby the remainder of the drill pipe string, are rotated within and relative to the torque transfer tube apparatus with the rotary drive apparatus to drill into the earth while sliding the torque transfer tube apparatus a) through and in contact with a torque receiving structure received at least partially within the earth, and b) into the drilled hole. For example, FIG. 2 depicts such example downward drilling in mid-stroke, with FIG. 3 depicting completion of drilling with the segment of drill pipe that is connected to the rotary drive apparatus essentially at the end of a downward drilling stroke. Thereafter, the supporting, rotating, and sliding actions as just-stated can be repeated one or more times with additional segments of drill pipe. By way of examples only, example manners of contending with the same are described with reference to FIGS. 4-9.

Figure 4:
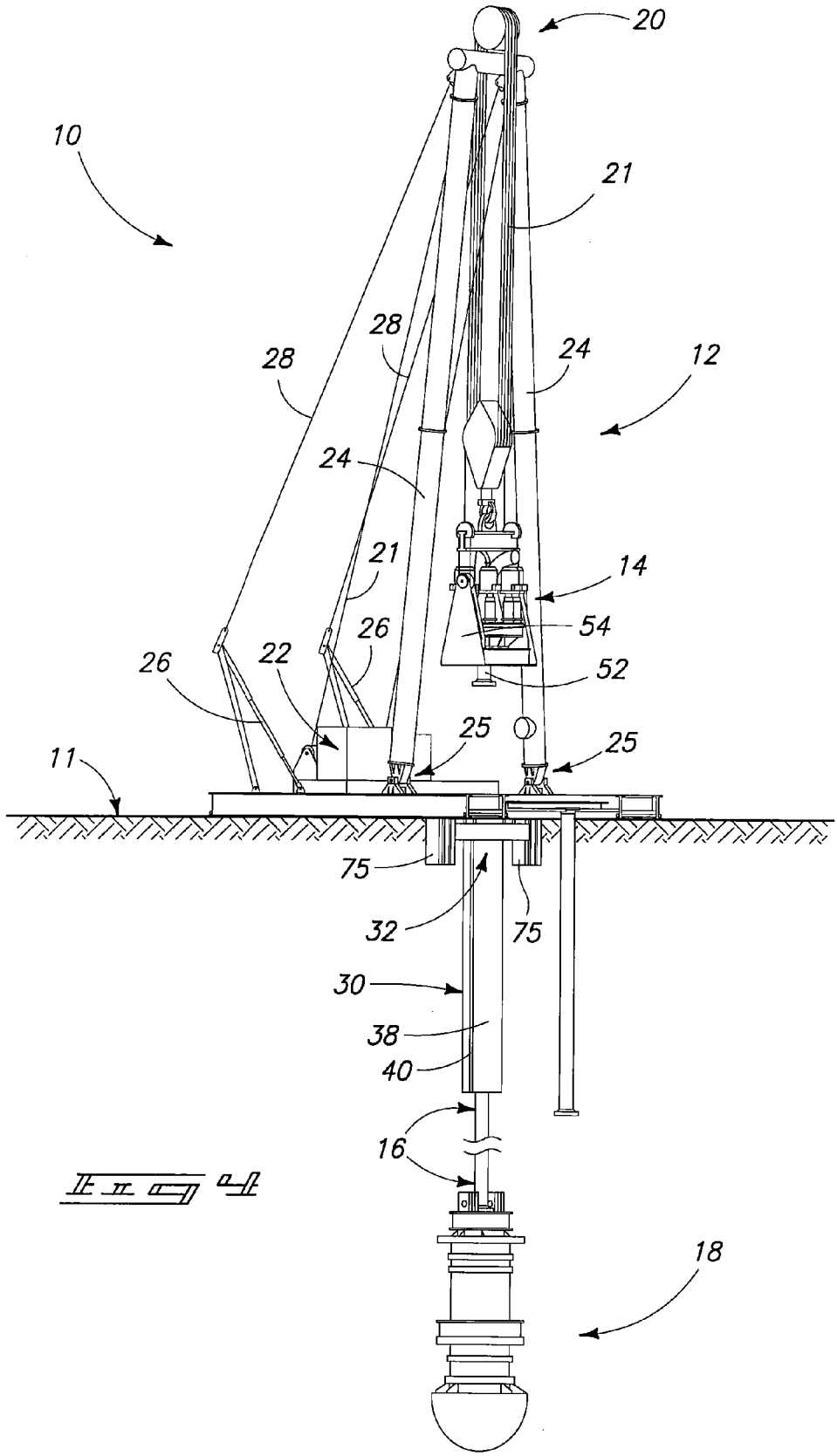
FIG. 4 is a view of the FIG. 1 assembly in yet another operational orientation.

In one implementation, the torque transfer tube apparatus is slid into the hole being dug until an upper portion of the torque transfer tube apparatus is precluded from further sliding through the torque receiving structure by radial projections which contact the torque receiving structure. Then, the rotary drive apparatus and torque transfer tube apparatus are separated. For example, FIGS. 4-6 depict disengagement of torque transfer tube apparatus 30 from rotary drive apparatus 14 by disengagement of pins (not shown) from holes 42 of radial projections 41 and from the holes in clevis plates 62 on rotary drive apparatus 14 (FIG. 6). Prior thereto, FIG. 5 depicts the torque transfer tube apparatus 30 as having been slidably extended through torque receiving structure 32 such that radial projections 41 bear against the upper surface of torque receiving structure 32, thereby precluding torque transfer tube apparatus 30 from further sliding through the torque receiving structure and with torque transfer tube apparatus 30 being supported elevationally by torque receiving structure 32. Output shaft 52 and the outermost segment of projecting drill pipe string 16 are disconnected from one another, for example thereby separating the rotary drive apparatus from such segment of drill pipe.

Figure 7:
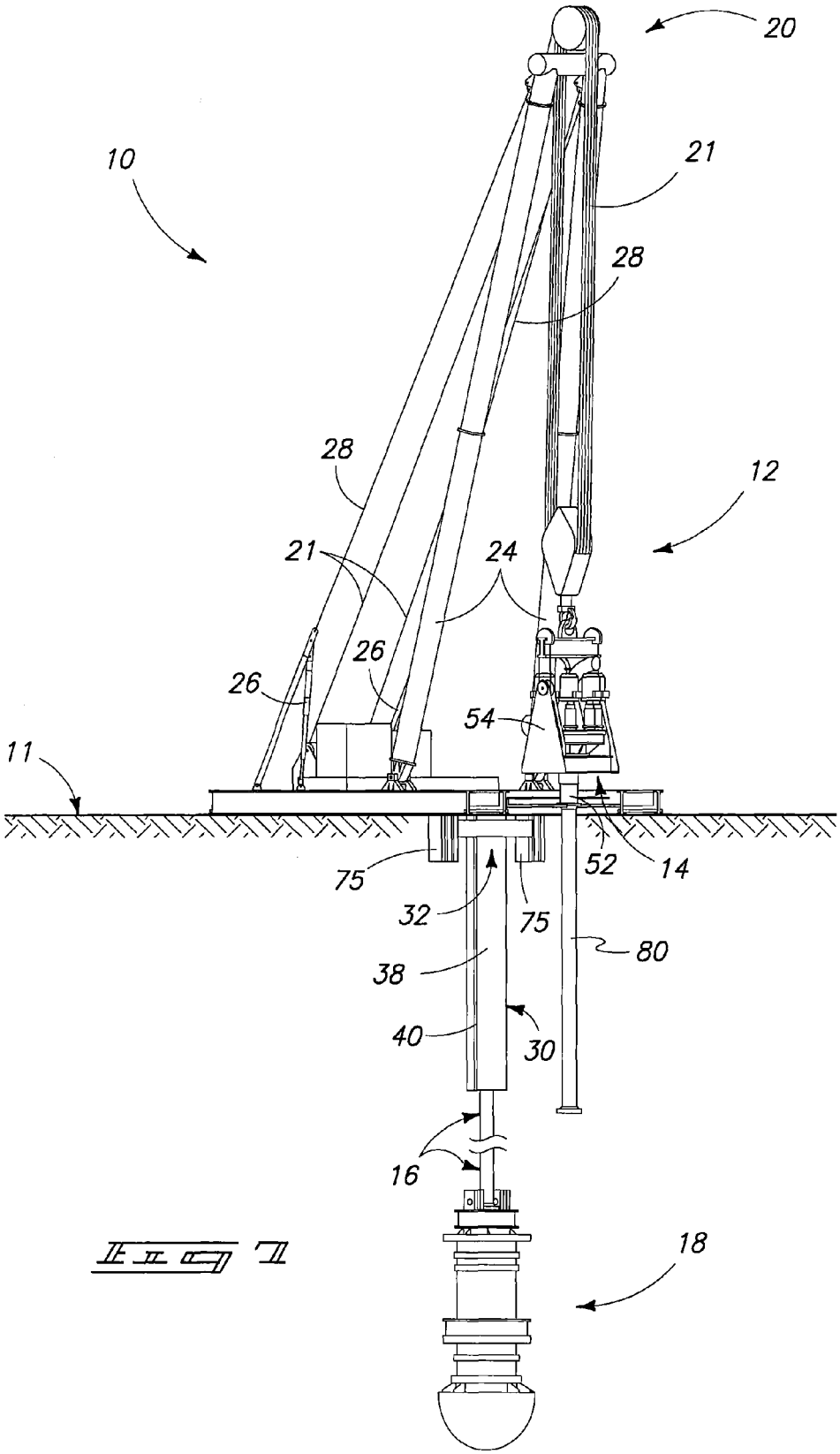
FIG. 7 is a view of the FIG. 1 assembly in another operational orientation.

Referring to FIG. 7, another segment of drill pipe 80 is shown as having been conveniently staged within another hole in the ground. Boom legs 24 of drill rig mast apparatus 12 have been pivoted forward about pivots 25 by operation of hydraulic cylinders 26 to position rotary drive apparatus 14 directly over such next drill pipe segment 80. Thereafter, drill pipe segment 80 is bolted or otherwise connected to drive output 52 on rotary drive apparatus 14.

Figure 8:
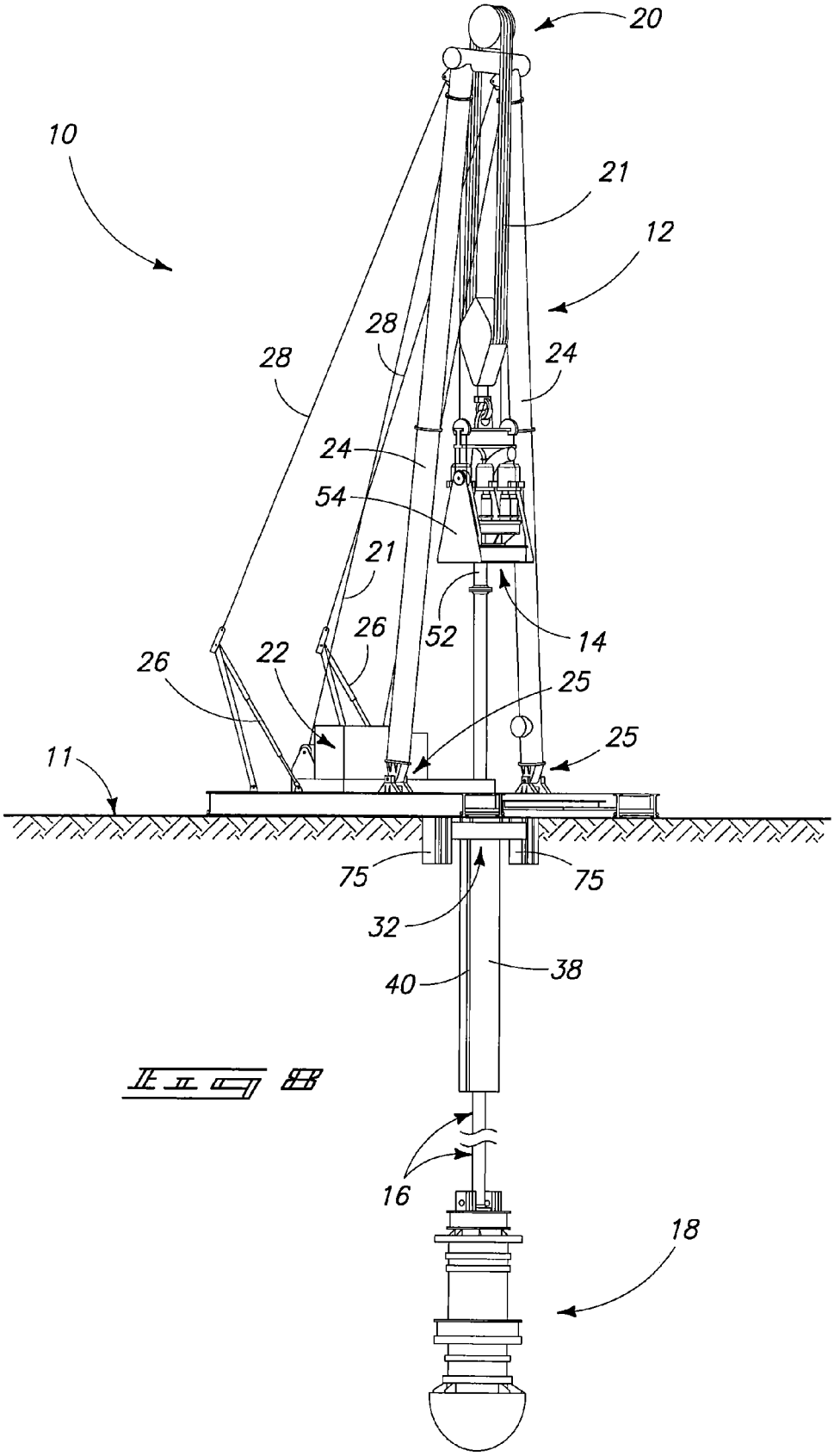
FIG. 8 is a view of the FIG. 1 assembly in another operational orientation.

Referring to FIG. 8, block and tackle assembly 20 has raised drill pipe segment 80 from out of the ground, and hydraulic cylinders 26 have been operated to move rotary drive apparatus 14 with drill pipe segment 80 to over the drill string received within the ground. Block and tackle apparatus 20 would be operated sufficiently to lower the drill segment 80 over the drill string received within the ground, and the flanges thereof interconnected with nuts and bolts (in one example).

Figure 9:
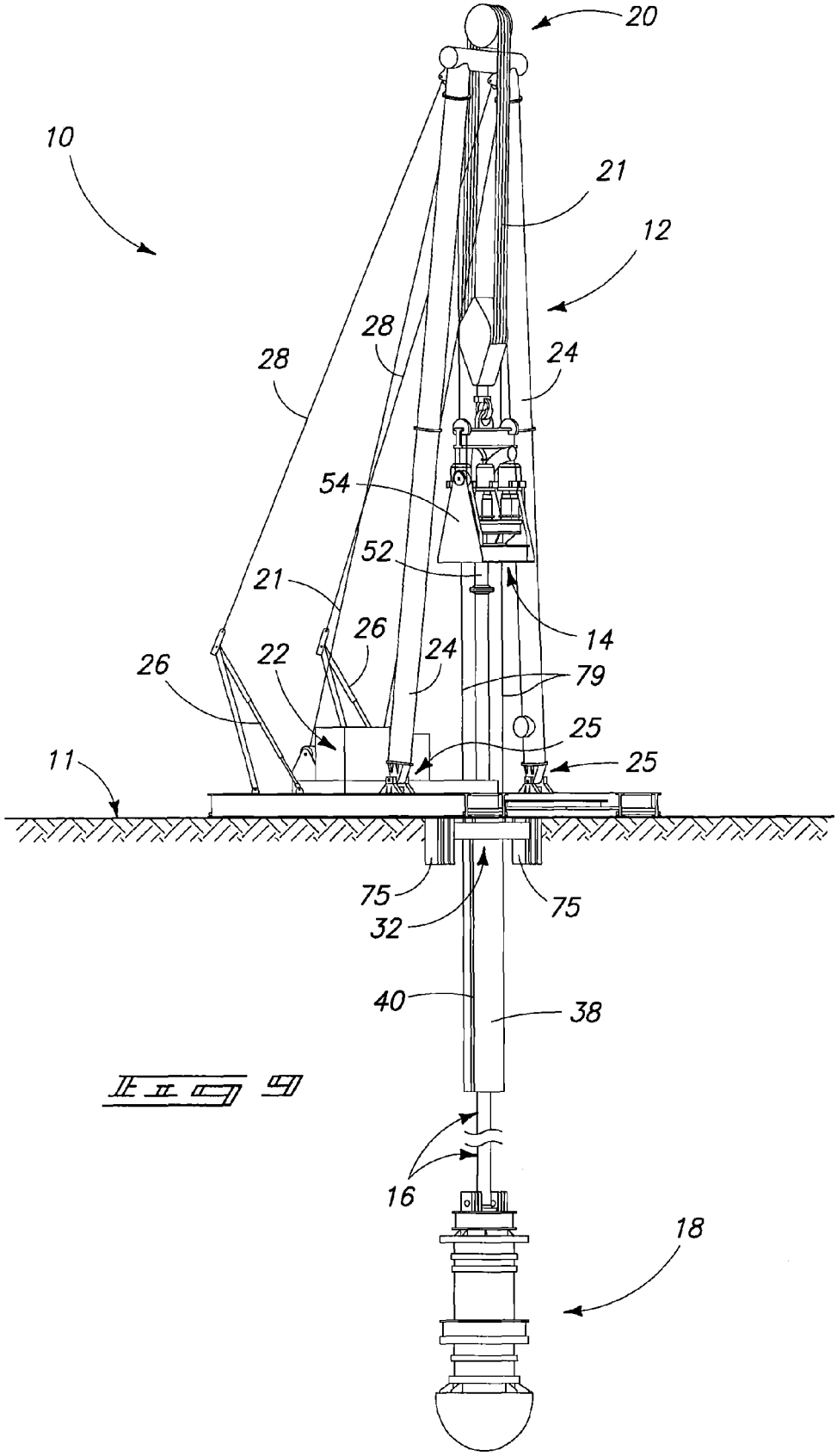
FIG. 9 is a view of the FIG. 1 assembly in another operational orientation.

Referring to FIG. 9, cables 79 are depicted as extending downwardly through drive lifting frame 54 of rotary drive apparatus 14 to the torque transfer tube apparatus 30 as received by the torque receiving structure 32. Such cables would be connected through the openings 46 in radial projections 44 on torque transfer tube apparatus 30. Thereafter, the cables would be raised to elevate torque transfer tube apparatus 30 into engagement with rotary drive apparatus 14. Locking pins would then be driven through clevis-like projections 62 and the holes in radial projections 41 to elevationally support torque transfer tube apparatus 30 from and to extend below rotary drive apparatus 14, for example resulting again in the FIG. 1 orientation. The drilling process can then be repeated.

The equipment as depicted might be used to initially start the hole being drilled. Alternately, other equipment or only some of the depicted equipment might be used to start the hole into which torque tube main portion 38 is slidably received. For example, and by way of example only, torque receiving structure 32 could be connected with rotary drive apparatus 14 directly and/or with a short starter torque transfer tube (not shown) instead of with torque tube apparatus 30. Such could be a very short stub having the same outer shape as the upper portion of torque transfer tube apparatus 30, and which extends into opening 70 of connected torque receiving structure 32, but not significantly there-below if at all. The torque receiving structure could be slidably supported at its ends by a pair of vertically projecting starter beams (not shown) for up and down sliding movement relative thereto. A short piece of drill pipe would connect with rotary drive apparatus 14 and extend downwardly to a cutting head received below torque receiving structure 32. Accordingly, the rotary drive apparatus can drive the cutting head and move up and down along the length of the starter beams, with counter-rotational torque being transferred to the starter beams via the short torque transfer tube stub and the sliding torque receiving structure.

At the end of a downward drilling stroke, the rotary drive apparatus can be disconnected from the drill pipe, raised relative to the starter beams and ground, and another section of drill pipe added. Alternately by way of example only, the rotary drive apparatus with cutting head attached can be raised relative to the starter beams and ground, then temporarily supported while the rotary drive apparatus is disconnected and some other piece of drill pipe is attached to the end of the drill pipe attached to the cutting head. Regardless, the downward drilling stroke can be repeated, and drill pipe segments subsequently added, until depth of the hole is at least as deep as length of the torque transfer tube apparatus 30. Then, torque receiving structure 32 can be removed from rotary drive apparatus 14 and appropriately anchored for use with torque transfer tube apparatus 30. Ideally, the length of the downward drilling stroke is limited in the starting configuration by use of short starter beams to avoid the higher leverage force that would otherwise be applied to longer starter beams if conventional full lengths of drill pipe were used to start the hole. Any alternate manner for creating a starter hole is of course contemplated.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A drilling assembly, comprising:

a rotary drive apparatus configured to rotate a string of drill pipe having a cutting head at a drilling end of the string of drill pipe;

a longitudinally elongated torque transfer tube apparatus mounted to and extending downwardly from the rotary drive apparatus and configured to longitudinally receive the string of drill pipe rotatably there-through, the torque transfer tube apparatus being isolated from rotation relative to the rotary drive apparatus and the string of drill pipe during drilling with the drilling assembly; and a torque receiving structure through which the torque transfer tube apparatus is upwardly slidably received, and through which the torque transfer tube apparatus is downwardly slidably received during drilling with the drilling assembly, the torque transfer tube apparatus and the torque receiving structure being isolated from rotation relative one another and the string of drill pipe during drilling with the drilling assembly, torque being transferred from the torque transfer tube apparatus to the torque receiving structure during drilling with the drilling assembly.

2. The assembly of claim 1 wherein the longitudinally elongated torque tube apparatus is sized to have a sufficiently great internal diameter to preclude contact of the string of drill pipe for which the assembly is designed with the torque transfer tube apparatus during drilling with the drilling assembly.

3. The assembly of claim 1 wherein the torque transfer tube apparatus is internally circular in transverse cross section.

4. The assembly of claim 1 wherein the torque transfer tube apparatus has a non-circular external shape in transverse cross section to isolate the torque transfer tube apparatus from rotating relative to the rotary drive apparatus, the torque receiving structure, and the string of drill pipe during drilling with the drilling assembly.

5. The assembly of claim 1 wherein the torque transfer tube apparatus has an upper end, the rotary drive apparatus comprising a lower end having an opening into which the upper end of the torque transfer tube apparatus is received, the torque transfer tube apparatus having a non-circular external shape in transverse cross section at its upper end which engages with the lower end of the rotary drive apparatus when received within the rotary drive apparatus opening to isolate the torque transfer tube apparatus from rotating relative to the rotary drive apparatus and the string of drill pipe during drilling with the drilling assembly.

6. The assembly of claim 5 wherein the torque transfer tube apparatus comprises a longitudinally elongated tube portion and a plurality of longitudinal projections extending upwardly from the longitudinally elongated tube portion, the longitudinal projections being received within the rotary drive apparatus lower end opening and at least in part defining said non-circular external shape of the upper end of the torque tube apparatus.

7. The assembly of claim 6 wherein the plurality of longitudinal projections comprises a pair of diametrically opposed longitudinal projections.

8. The assembly of claim 1 wherein the torque transfer tube apparatus and the torque receiving structure are isolated from rotation relative one another by at least two pairs of a mating transverse slot and transverse projection on the torque transfer tube apparatus and the torque receiving structure, the transverse slot and transverse projection of each pair being oriented transverse the torque transfer tube apparatus and engaging one another to be longitudinally slidable relative one another and to preclude rotation of the torque transfer tube apparatus relative to the torque receiving structure during drilling with the drilling assembly.

9. The assembly of claim 8 wherein two of the at least two pairs are diametrically opposed to one another relative to the torque transfer tube apparatus.

10. The assembly of claim 8 wherein the pairs are only two in number.

11. The assembly of claim 8 wherein at least one of the transverse slots is on the torque receiving structure and at least one of the transverse projections is on the torque transfer tube apparatus.

12. The assembly of claim 8 wherein all of the transverse slots are on the torque receiving structure and all of the transverse projections are on the torque transfer tube apparatus.

13. The assembly of claim 8 wherein the torque transfer tube apparatus comprises a longitudinally elongated tube portion and a plurality of longitudinal projections extending upwardly from the longitudinally elongated tube portion, the longitudinal projections being received within the rotary drive apparatus lower end opening and at least in part defining said non-circular external shape of the upper end of the torque tube apparatus.

14. The assembly of claim 1 wherein the torque receiving structure has an opening through which the torque transfer tube apparatus is slidably received, the torque transfer tube apparatus having an upper end, the torque transfer tube apparatus comprising radial projections proximate the upper end to preclude the torque transfer tube apparatus from being able to slide completely downwardly through the opening in the torque receiving structure.

15. The assembly of claim 1 wherein the torque transfer tube apparatus has an upper end, the torque transfer tube apparatus comprising transverse projections proximate the upper end, the rotary drive apparatus comprising a lower end having transverse slots which slidably receive the torque transfer tube apparatus transverse projections to preclude rotation of the torque transfer tube apparatus relative to the rotary drive apparatus.

16. The assembly of claim 1 wherein the torque receiving structure is elongated transverse the longitudinally elongated torque transfer tube apparatus.

17. A drilling assembly, comprising:

a rotary drive apparatus configured to rotate a string of drill pipe having a cutting head at a drilling end of the string of drill pipe;

a longitudinally elongated torque transfer tube apparatus mounted to and extending downwardly from the rotary drive apparatus and configured to longitudinally receive the string of drill pipe rotatably there-through, the torque transfer tube apparatus being isolated from rotation relative to the rotary drive apparatus and the string of drill pipe during drilling with the drilling assembly;

a torque receiving structure through which the torque transfer tube apparatus is upwardly and downwardly slidably received, the torque transfer tube apparatus and the torque receiving structure being isolated from rotation relative one another and the string of drill pipe during drilling with the drilling assembly;

the torque transfer tube apparatus and the torque receiving structure being isolated from rotation relative one another by at least two pairs of a mating transverse slot and transverse projection on the torque transfer tube apparatus and the torque receiving structure, the transverse slot and transverse projection of each pair being oriented transverse the torque transfer tube apparatus and engaging one another to be longitudinally slidable relative one another and to preclude rotation of the torque transfer tube apparatus relative to the torque receiving structure during drilling with the drilling assembly;

at least one of the transverse slots is on the torque receiving structure and at least one of the transverse projections is on the torque transfer tube apparatus; and the torque transfer tube apparatus has having a length, the transverse projection on the torque transfer tube apparatus extending along at least a majority of the torque transfer tube apparatus length.

18. The assembly of claim 17 wherein the transverse projection on the torque transfer tube apparatus extends along an entirety of the torque transfer tube apparatus length.

19. A drilling assembly, comprising:

a rotary drive apparatus configured to rotate a string of drill pipe having a cutting head at a drilling end of the string of drill pipe;

a longitudinally elongated torque transfer tube apparatus mounted to and extending downwardly from the rotary drive apparatus and configured to longitudinally receive the string of drill pipe rotatably there-through, the torque transfer tube apparatus being isolated from rotation relative to the rotary drive apparatus and the string of drill pipe during drilling with the drilling assembly;

a torque receiving structure through which the torque transfer tube apparatus is upwardly and downwardly slidably received, the torque transfer tube apparatus and the torque receiving structure being isolated from rotation relative one another and the string of drill pipe during drilling with the drilling assembly;

the torque transfer tube apparatus and the torque receiving structure being isolated from rotation relative one another by at least two pairs of a mating transverse slot and transverse projection on the torque transfer tube apparatus and the torque receiving structure, the transverse slot and transverse projection of each pair being oriented transverse the torque transfer tube apparatus and engaging one another to be longitudinally slidable relative one another and to preclude rotation of the torque transfer tube apparatus relative to the torque receiving structure during drilling with the drilling assembly;

at least one of the transverse slots is on the torque receiving structure and at least one of the transverse projections is on the torque transfer tube apparatus; and the torque transfer tube apparatus having a lower end, the transverse projection on the torque transfer tube apparatus extending to the lower end of the torque transfer tube apparatus.

20. A drilling assembly, comprising:

a rotary drive apparatus configured to rotate a string of drill pipe having a cutting head at a drilling end of the string of drill pipe;

a longitudinally elongated torque transfer tube apparatus mounted to and extending downwardly from the rotary drive apparatus and configured to longitudinally receive the string of drill pipe rotatably there-through, the torque transfer tube apparatus being isolated from rotation relative to the rotary drive apparatus and the string of drill pipe during drilling with the drilling assembly;

a torque receiving structure through which the torque transfer tube apparatus is upwardly and downwardly slidably received, the torque transfer tube apparatus and the torque receiving structure being isolated from rotation relative one another and the string of drill pipe during drilling with the drilling assembly;

the torque transfer tube apparatus and the torque receiving structure being isolated from rotation relative one another by at least two pairs of a mating transverse slot and transverse projection on the torque transfer tube apparatus and the torque receiving structure, the transverse slot and transverse projection of each pair being oriented transverse the torque transfer tube apparatus and engaging one another to be longitudinally slidable relative one another and to preclude rotation of the torque transfer tube apparatus relative to the torque receiving structure during drilling with the drilling assembly;

the torque transfer tube apparatus comprising a longitudinally elongated tube portion and a plurality of longitudinal projections extending upwardly from the longitudinally elongated tube portion, the longitudinal projections being received within the rotary drive apparatus lower end opening and at least in part defining said non-circular external shape of the upper end of the torque tube apparatus; and all of the transverse slots being on the torque receiving structure and all of the transverse projections being on the torque transfer tube apparatus, the longitudinal projections comprising longitudinal extensions of the transverse projections.

21. A drilling assembly, comprising:

a rotary drive apparatus configured to rotate a string of drill pipe having a cutting head at a drilling end of the string of drill pipe;

a longitudinally elongated torque transfer tube apparatus mounted to and extending downwardly from the rotary drive apparatus and configured to longitudinally receive the string of drill pipe rotatably there-through, the torque transfer tube apparatus being isolated from rotation relative to the rotary drive apparatus and the string of drill pipe during drilling with the drilling assembly;

a torque receiving structure through which the torque transfer tube apparatus is upwardly and downwardly slidably received, the torque transfer tube apparatus and the torque receiving structure being isolated from rotation relative one another and the string of drill pipe during drilling with the drilling assembly; and concrete within which the torque receiving structure is received.

22. The assembly of claim 21 wherein the torque receiving structure is slidably received within the concrete for removal therefrom.

23. A drilling assembly, comprising:

a rotary drive apparatus configured to rotate a string of drill pipe having a cutting head at a drilling end of the string of drill pipe;

a longitudinally elongated torque transfer tube apparatus mounted to and extending downwardly from the rotary drive apparatus and configured to longitudinally receive the string of drill pipe rotatably there-through, the torque transfer tube apparatus being isolated from rotation relative to the rotary drive apparatus and the string of drill pipe during drilling with the drilling assembly;

a torque receiving structure through which the torque transfer tube apparatus is upwardly and downwardly slidably received, the torque transfer tube apparatus and the torque receiving structure being isolated from rotation relative one another and the string of drill pipe during drilling with the drilling assembly; and concrete received at least partially below a ground surface above which the rotary drive apparatus is supported, the torque receiving structure being received at least partially within that portion of the concrete which is below the ground surface.

24. The assembly of claim 23 wherein the torque receiving structure is slidably received within the concrete for removal therefrom.

25. A drilling assembly, comprising:

a rotary drive apparatus configured to rotate a string of drill pipe having a cutting head at a drilling end of the string of drill pipe;

a longitudinally elongated torque transfer tube apparatus mounted to and extending downwardly from the rotary drive apparatus and configured to longitudinally receive the string of drill pipe rotatably there-through, the torque transfer tube apparatus being isolated from rotation relative to the rotary drive apparatus and the string of drill pipe during drilling with the drilling assembly;

a torque receiving structure through which the torque transfer tube apparatus is upwardly and downwardly slidably received, the torque transfer tube apparatus and the torque receiving structure being isolated from rotation relative one another and the string of drill pipe during drilling with the drilling assembly; and a ground surface above which the rotary drive apparatus is supported, the torque receiving structure being received entirely below the ground surface.

26. A drilling assembly, comprising:

a drill rig mast apparatus extending upwardly relative to a ground surface;

a rotary drive apparatus supported for up and down movement by the drill rig mast apparatus, the rotary drive apparatus being configured to rotate a string of drill pipe having a cutting head at a drilling end of the string of drill pipe, the rotary drive apparatus comprising a lower end having an opening therein;

a longitudinally elongated torque transfer tube apparatus mounted to and extending downwardly from the rotary drive apparatus and configured to longitudinally receive the string of drill pipe rotatably there-through, the torque transfer tube apparatus having an upper end received within the rotary drive apparatus opening, the torque transfer tube apparatus having a non-circular external shape in transverse cross section at its upper end which engages with the lower end of the rotary drive apparatus to isolate the torque transfer tube apparatus from rotating relative to the rotary drive apparatus and the string of drill pipe during drilling with the drilling assembly; and a torque receiving structure received at least partially below the ground surface and through which the torque transfer tube apparatus is upwardly and downwardly slidably received, the torque transfer tube apparatus having a non-circular external shape in transverse cross section below its upper end along at least a majority of its length which engages with the torque receiving structure while sliding relative thereto to isolate the torque transfer tube apparatus from rotating relative to the torque receiving structure during drilling with the drilling assembly.

27. The assembly of claim 26 wherein the non-circular external shape of the torque transfer tube apparatus is at least in part characterized by at least two pairs of a mating transverse slot and transverse projection on the torque transfer tube apparatus and the torque receiving structure, the transverse slot and transverse projection of each pair being oriented transverse the torque transfer tube apparatus and engaging one another to be longitudinally slidable relative one another and to preclude rotation of the torque transfer tube apparatus relative to the torque receiving structure during drilling with the drilling assembly.

28. The assembly of claim 27 wherein two of the at least two pairs are diametrically opposed to one another relative to the torque transfer tube apparatus.

29. The assembly of claim 26 wherein the torque receiving structure has an opening through which the torque transfer tube apparatus is slidably received, the torque transfer tube apparatus comprising radial projections proximate the upper end to preclude the torque transfer tube apparatus from being able to slide completely downwardly through the opening in the torque receiving structure.

30. The assembly of claim 26 further comprising concrete received at least partially below the ground surface, the torque receiving structure being received at least partially within that portion of the concrete which is below the ground surface.

31. The assembly of claim 30 wherein the torque receiving structure is slidably received within the concrete for removal therefrom.

32. A method of drilling, comprising:

supporting a longitudinally elongated torque transfer tube apparatus extending beneath a rotary drive apparatus at least partially above a hole in the earth, the rotary drive apparatus being connected with a first segment of drill pipe that extends into the torque transfer tube apparatus and connects with a string of drill pipe received within the hole;

rotating the first segment and string of drill pipe within and relative to the torque transfer tube apparatus with the rotary drive apparatus to drill into the earth while sliding the torque transfer tube apparatus a) through and in contact with a torque receiving structure received at least partially within the earth, and b) into the hole; and repeating said supporting, said rotating, and said sliding with a second segment of drill pipe.

33. The method of claim 32 comprising prior to said repeating, sliding the torque transfer tube apparatus into the hole until an upper portion of the torque transfer tube apparatus is precluded from further sliding through the torque receiving structure by radial projections which contact the torque receiving structure.

34. The method of claim 33 comprising prior to said repeating:

after contacting the torque receiving structure with the radial projections, separating the rotary drive apparatus from the torque transfer tube apparatus;

after separating the rotary drive apparatus from the torque transfer tube apparatus, separating the first segment of drill pipe from the rotary drive apparatus.

35. The method of claim 34 comprising prior to said repeating and after separating the first segment of drill pipe from the rotary drive apparatus, connecting the rotary drive apparatus with the second segment of drill pipe.

36. The method of claim 35 comprising prior to said repeating and after connecting the rotary drive apparatus with the second segment of drill pipe, connecting the second segment of drill pipe with the drill string.

37. The method of claim 36 comprising after connecting the second segment of drill pipe with the drill string, lifting the torque transfer tube apparatus at least partially from the hole to the rotary drive apparatus and supporting the longitudinally elongated torque transfer tube apparatus from the rotary drive apparatus at least partially above the hole in the earth.

38. A method of drilling, comprising:

supporting a longitudinally elongated torque transfer tube apparatus extending beneath a rotary drive apparatus at least partially above a hole in the earth, the rotary drive apparatus being connected with a segment of drill pipe that extends into the torque transfer tube apparatus and connects with a string of drill pipe received within the hole; and rotating the segment and string of drill pipe within and relative to the torque transfer tube apparatus with the rotary drive apparatus to drill into the earth while sliding the torque transfer tube apparatus a) through and in contact with a torque receiving structure received at least partially within the earth, and b) into the hole.

39. A method of drilling, comprising:

supporting a longitudinally elongated torque transfer tube apparatus extending beneath a rotary drive apparatus at least partially above a hole in the earth, the rotary drive apparatus being connected with a segment of drill pipe that extends into the torque transfer tube apparatus and connects with a string of drill pipe received within the hole;

rotating the segment and string of drill pipe within and relative to the torque transfer tube apparatus with the rotary drive apparatus to drill into the earth while sliding the torque transfer tube apparatus a) through and in contact with a torque receiving structure received at least partially within the earth, and b) into the hole; and repeating said supporting, said rotating, and said sliding multiple times with additional segments of drill pipe.

* * * * *